US009979126B2

(12) United States Patent
Takamura

(10) Patent No.: US 9,979,126 B2
(45) Date of Patent: May 22, 2018

(54) LEVER TYPE CONNECTOR

(71) Applicant: YAZAKI CORPORATION, Tokyo (JP)

(72) Inventor: Naoki Takamura, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days. days.

(21) Appl. No.: 15/630,107

(22) Filed: Jun. 22, 2017

(65) Prior Publication Data

US 2018/0013233 A1 Jan. 11, 2018

(30) Foreign Application Priority Data

Jul. 8, 2016 (JP) ..... 2016-135673

(51) Int. Cl.
*H01R 13/62* (2006.01)
*H01R 13/629* (2006.01)

(52) U.S. Cl.
CPC . *H01R 13/62933* (2013.01); *H01R 13/62938* (2013.01); *H01R 13/62955* (2013.01)

(58) Field of Classification Search
CPC ..... H01R 13/62933; H01R 13/62938; H01R 13/62955
USPC ..... 439/157, 372
See application file for complete search history.

(56) References Cited

U.S. PATENT DOCUMENTS 6,905,355 B2 * 6/2005 Fukamachi ..... H01R 13/62933 439/157
7,063,547 B2 * 6/2006 Toyoda ..... H01R 13/62911 439/157
2013/0115801 A1 * 5/2013 Kobayashi ..... H01R 13/4362 439/372

FOREIGN PATENT DOCUMENTS

JP 2014-207169 A 10/2014

* cited by examiner

*Primary Examiner* — Abdullah Riyami
*Assistant Examiner* — Justin Kratt
(74) *Attorney, Agent, or Firm* — Sughrue Mion, PLLC

(57) ABSTRACT

A lever type connector includes: a housing fittable with an opposite housing; a lever rotatably attached to the housing; shafts protruding from the both side surfaces of the housing respectively; and hole portions arranged in the pair of side plates respectively, the hole portions into which the shafts are inserted. Each of the shafts includes a protrusion protruding toward an outer side in a radial direction of the shaft at a distal end of the shaft. Each of the hole portions includes an opening prevention wall arranged at an edge of the hole portion and facing an inner side surface of the protrusion with the shaft being inserted into the hole portion. The opening prevention wall includes a plurality of insertion portions into which the protrusion is insertable.

3 Claims, 14 Drawing Sheets

LEVER TYPE CONNECTOR

CROSS REFERENCE TO RELATED APPLICATION

This application is based upon and claims the benefit of priority from the prior Japanese Patent Application No. 2016-135673, filed on Jul. 8, 2016, the entire contents of which are incorporated herein by reference.

BACKGROUND

1. Technical Field

The disclosure relates to a lever type connector.

2. Related Art

JP 2014-207169 A discloses a lever type connector provided with a housing which can be fitted with an opposite housing, a U-shape lever rotatably attached to the housing and formed to fit the opposite housing with the housing by rotation of the U-shape lever, a shaft arranged to be protruded from both side surfaces of the housing, and shaft receiving portions formed on each of a pair of the side plates arranged on each of the side surfaces of the housing of the lever, each of the shaft receiving portion formed as a hole portion into which the shaft is inserted.

In the lever type connector, a pair of drop-off prevention pieces formed as a protrusion is arranged at a distal end of the shaft and a drop-off prevention piece receiving portion formed as an insertion portion is arranged on the shaft receiving portion at a part corresponding to a pair of the drop-off prevention pieces.

In the lever type connector, an engagement piece of the shaft is positioned to be matched with the drop-off prevention piece receiving portion of the shaft receiving portion so that the pair of side plates of the lever is allowed to be opened to perform attaching of the lever to the housing or detaching of the lever from the housing.

SUMMARY

In the lever type connector described above, a position in which the protrusion of the shaft and the insertion portion of the hole portion are matched with each other to enable a pair of the side plates of the lever to be opened is set in only one position in a rotation direction of the lever against the housing.

Thus, in the lever type connector described above, when the attaching of the lever to the housing or the detaching of the lever from the housing is performed, it is necessary to rotate the lever toward the position set in only one position in which the protrusion of the shaft and the insertion portion of the hole portion are matched with each other, and therefore assemblability of the lever to the housing is deteriorated.

An object of the disclosure is to provide a lever type connector in which assemblability of a lever to a housing is improved.

A lever type connector in accordance with some embodiments includes: a housing fittable with an opposite housing; a lever formed in a U-shape, rotatably attached to the housing, and having a pair of side plates arranged at both side surfaces of the housing, a rotation of the lever fitting the opposite housing with the housing; shafts protruding from the both side surfaces of the housing respectively; and hole portions arranged in the pair of side plates respectively, the hole portions into which the shafts are inserted. Each of the shafts includes a protrusion protruding toward an outer side in a radial direction of the shaft at a distal end of the shaft. Each of the hole portions includes an opening prevention wall arranged at an edge of the hole portion and facing an inner side surface of the protrusion with the shaft being inserted into the hole portion. The opening prevention wall includes a plurality of insertion portions into which the protrusion is insertable.

According to the configuration described above, since the insertion portions into which the protrusion can be inserted are arranged in the opening prevention wall, a position in which the protrusion of the shaft and the insertion portion of the hole portion are matched with each other to enable the pair of side plates of the lever to be opened can be defined by a plurality of positions in a rotation direction of the lever against the housing.

Thus, attaching of the lever to the housing or detaching of the lever from the housing can be performed while matching the protrusion of the shaft and the insertion portion of the hole portion with each other at a plurality of the positions in the rotation direction of the lever against the housing.

Accordingly, in the lever type connector, assemblability of the lever to the housing can be improved.

Each of the pair of side plates may include a groove arranged on an inner side surface of each of the pair of side plates, the groove communicating with the hole portion and leading the shaft to the hole portion upon attachment of the lever to the housing. The groove may include: an introduction taper located at a front end side of the groove in an attaching direction of the lever to the housing and inclined such that the introduction taper spreads toward an opening side of the groove; and a guide taper located at a bottom of the groove and inclined such that a depth of the groove is shallower from the opening side of the groove toward the hole portion.

According to the configuration described above, since the groove which is communicated with the hole portion to lead the shaft toward the hole portion when the lever is attached to the housing is arranged on the inner side surface of each of the pair of side plates, the shaft can be led precisely to the hole portion when the lever is attached to the housing.

Further, since the introduction taper and the guide taper are arranged in the groove, the shaft can be led stably to the groove by the introduction taper and the pair of side plates can be opened stably by the guide taper, and therefore the attaching of the lever to the housing can be performed easily.

One of the insertion portions and the groove may face each other with the hole portion being interposed between the one of the insertion portions and the groove.

According to the configuration described above, since one of the insertion portions is arranged to be opposite to the groove while interposing the hole portion with the groove, the protrusion of the shaft and the insertion portion can be matched with each other continuously by attaching operation of the lever to the housing, and therefore the attaching of the lever to the housing can be performed easily.

The opening prevention wall may include a regulator contactable with the protrusion in a rotation direction of the lever.

According to the configuration described above, since the the regulator contactable with the protrusion in the rotation direction of the lever is arranged in the opening prevention wall, the rotation of the lever can be regulated by contact between the protrusion and the regulator, and therefore downsizing can be achieved by reducing a useless rotation space of the lever.

DETAILED DESCRIPTION

Figure 1:
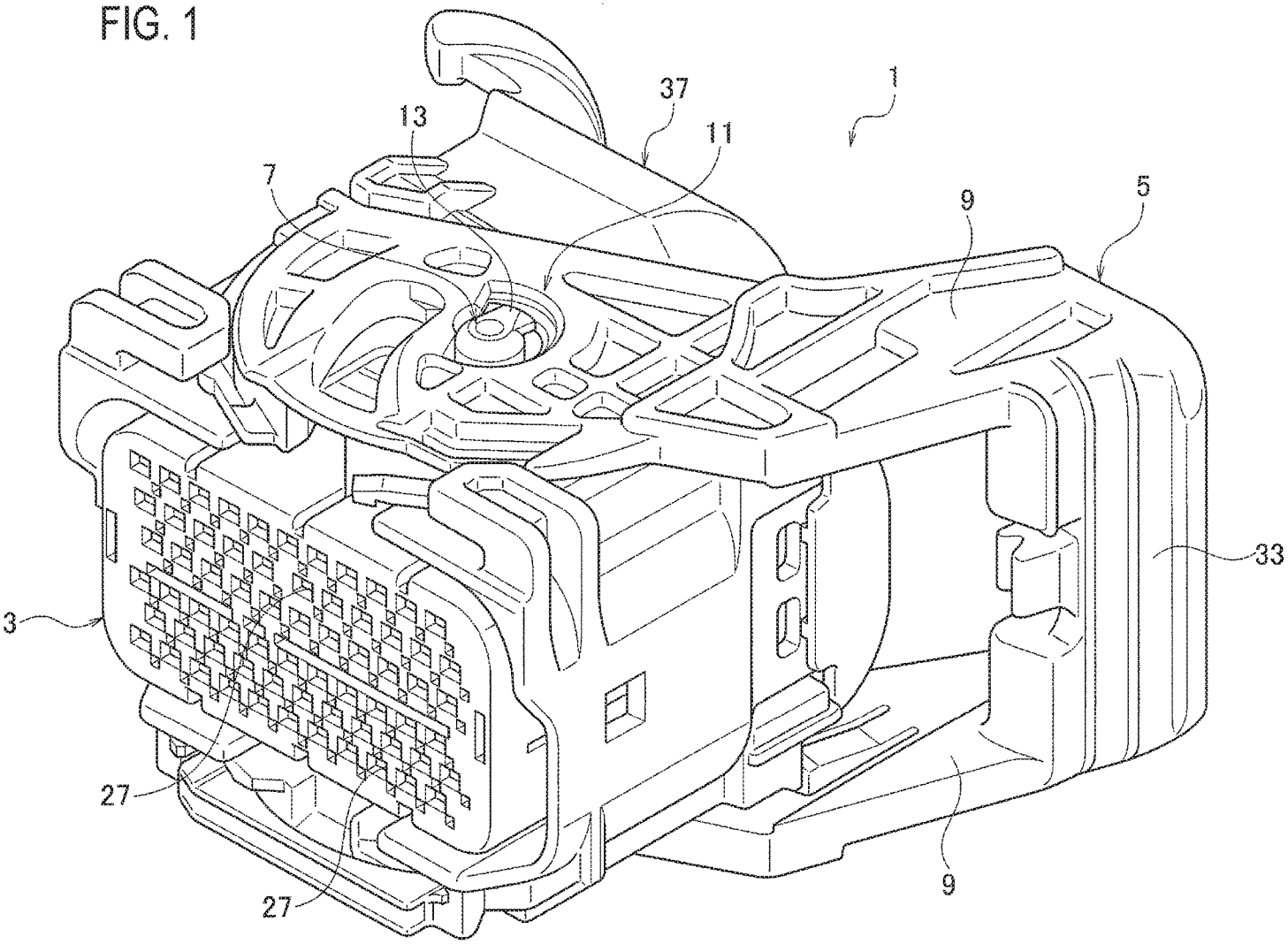
FIG. 1 is a perspective view of a lever type connector according to an embodiment of the present invention.
Figure 2:
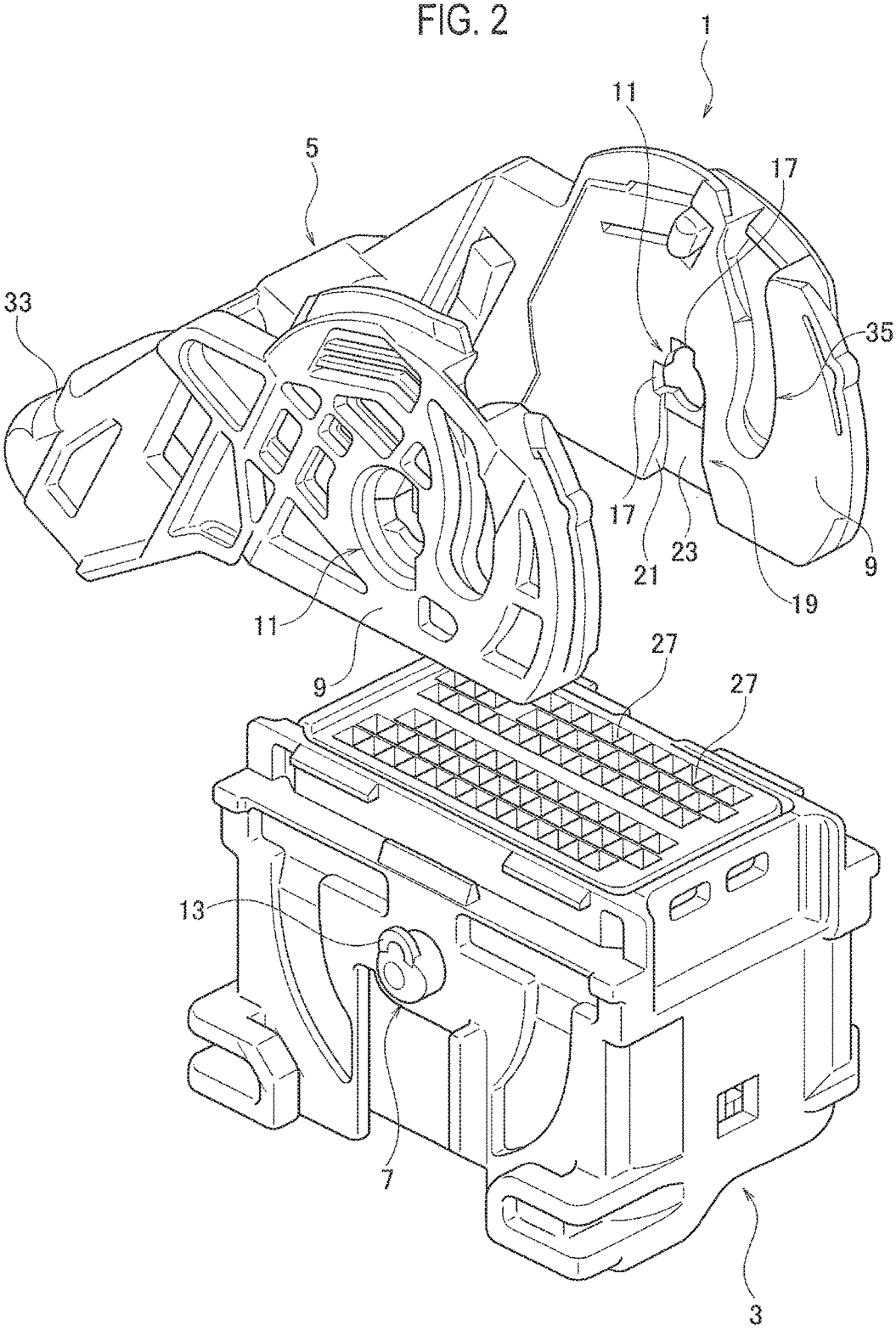
FIG. 2 is an exploded perspective view of the lever type connector according to the embodiment of the present invention.
Figure 3:
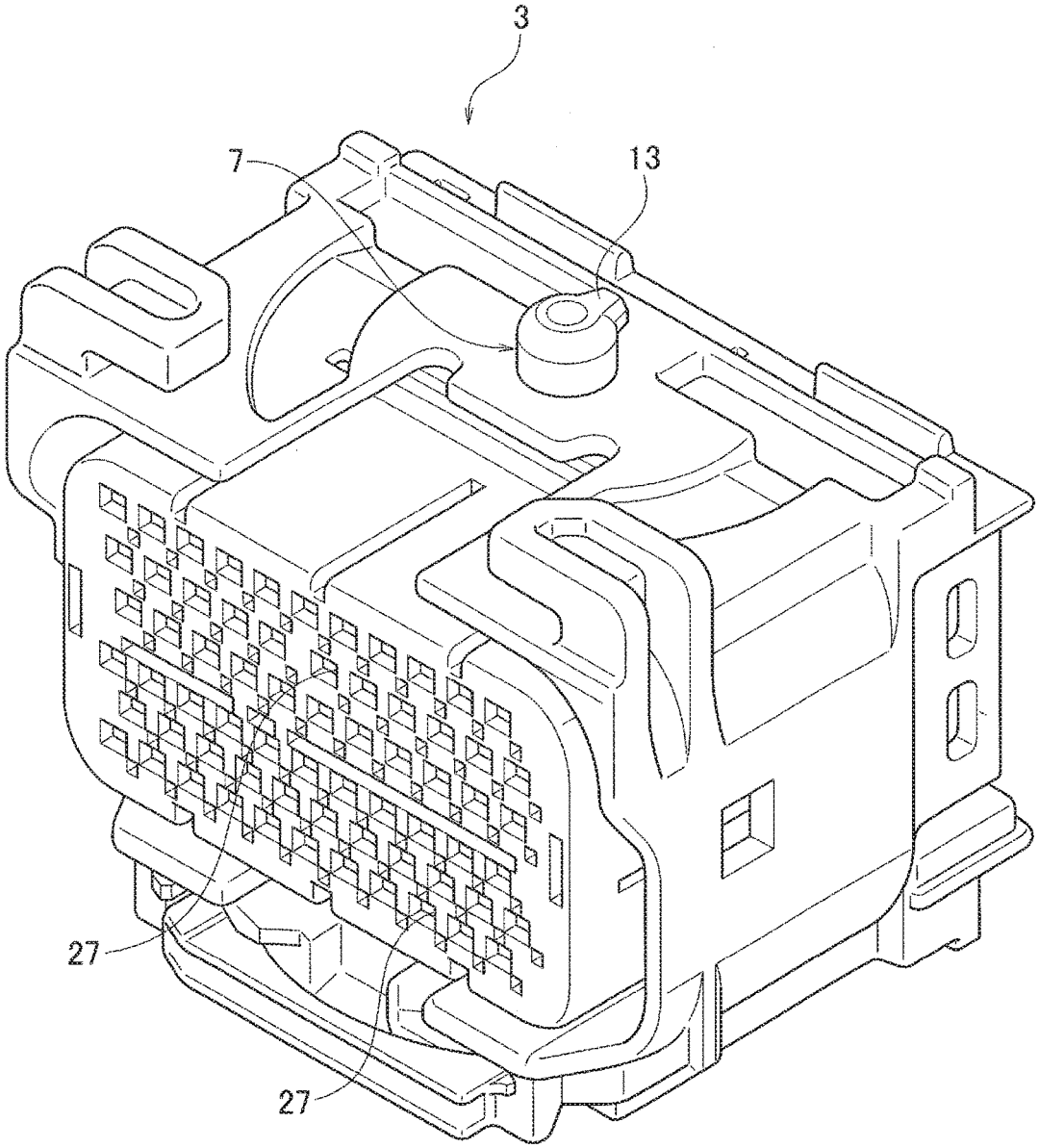
FIG. 3 is a perspective view of a housing of the lever type connector according to the embodiment.
Figure 4B:
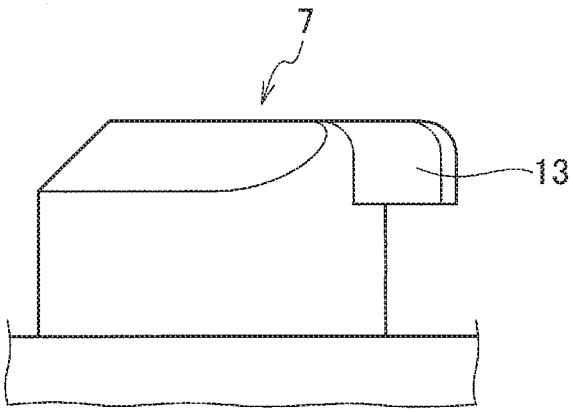
FIG. 4B is a side view of the shaft of the lever type connector according to the embodiment.
Figure 4A:
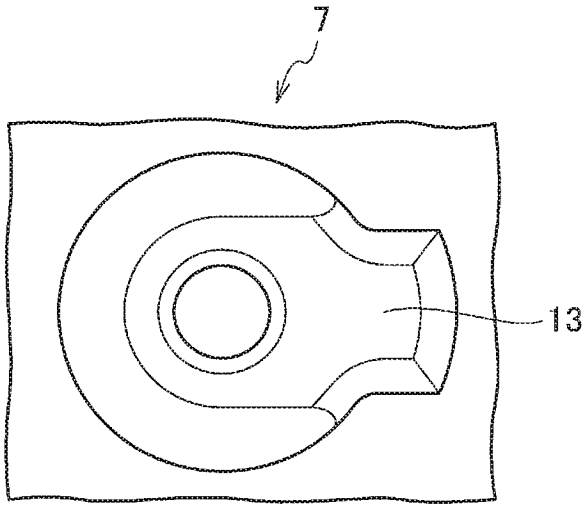
FIG. 4A is an upper view of a shaft of the lever type connector according to the embodiment.
Figure 5:
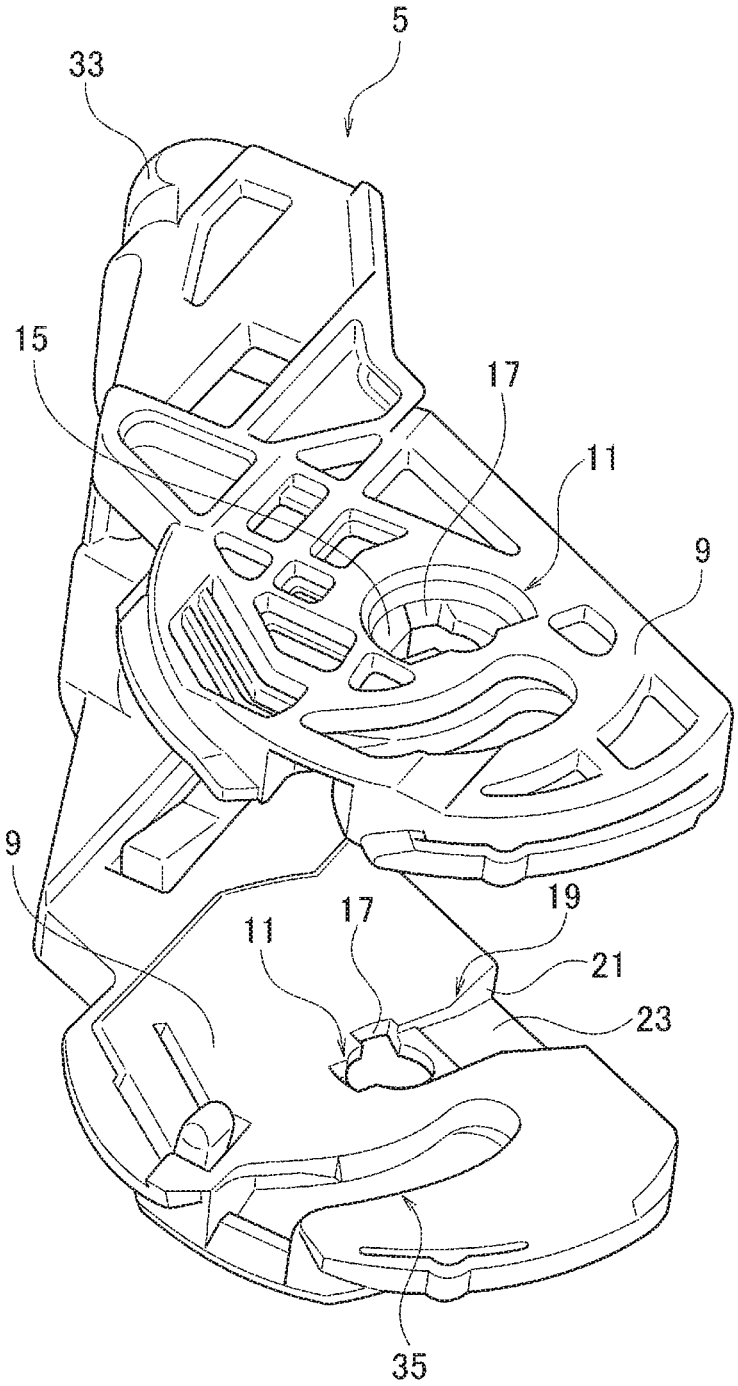
FIG. 5 is a perspective view of a lever of the lever type connector according to the embodiment.
Figure 6A:
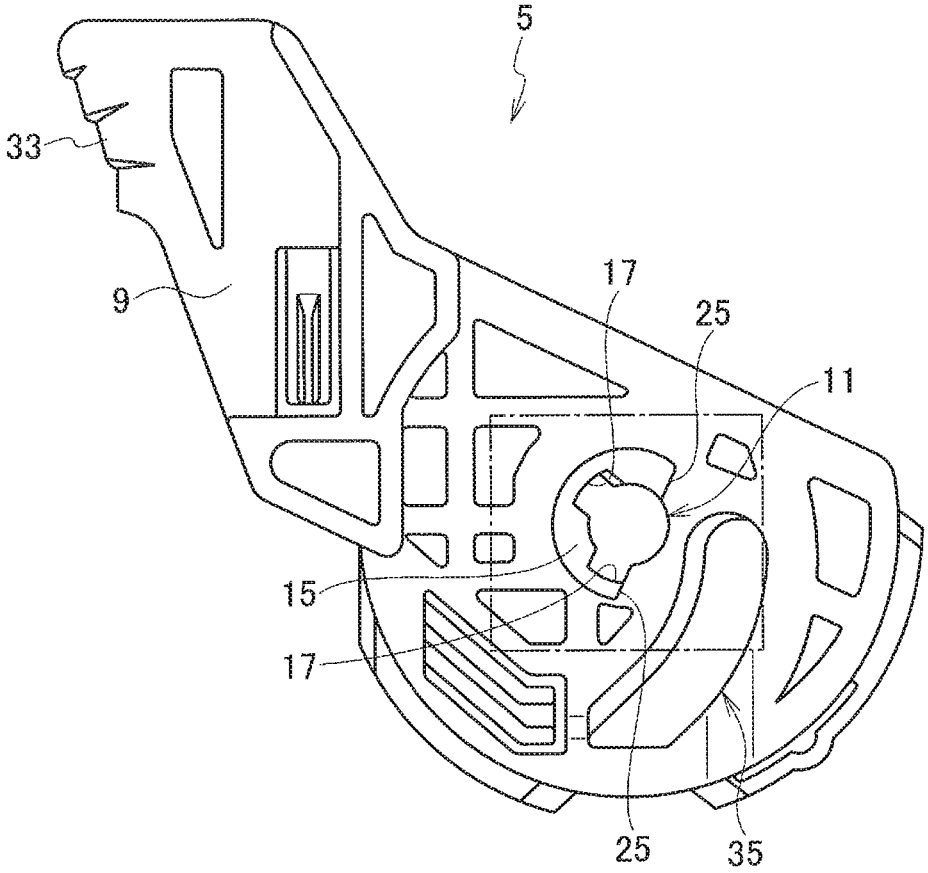
FIG. 6A is a side view of the lever of the lever type connector according to the embodiment.
Figure 6B:
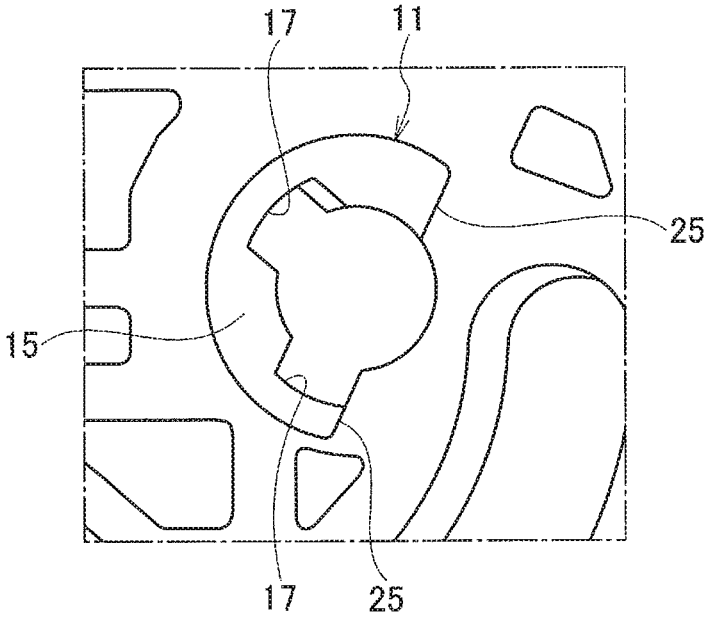
FIG. 6B is an enlarged view of a main part in FIG. 6A.
Figure 7B:
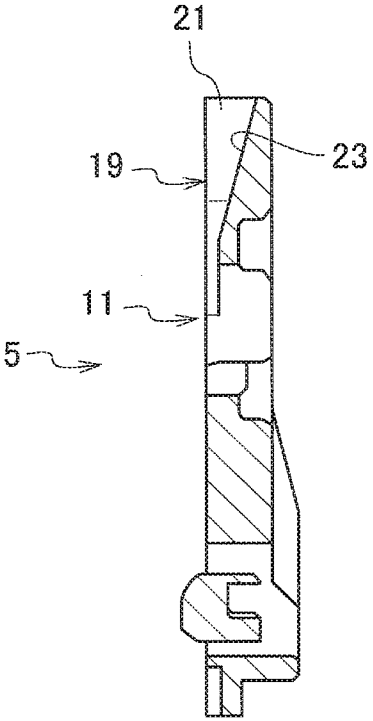
FIG. 7B is a cross-sectional view taken along line VIIB-VIIB in FIG. 7A.
Figure 7A:
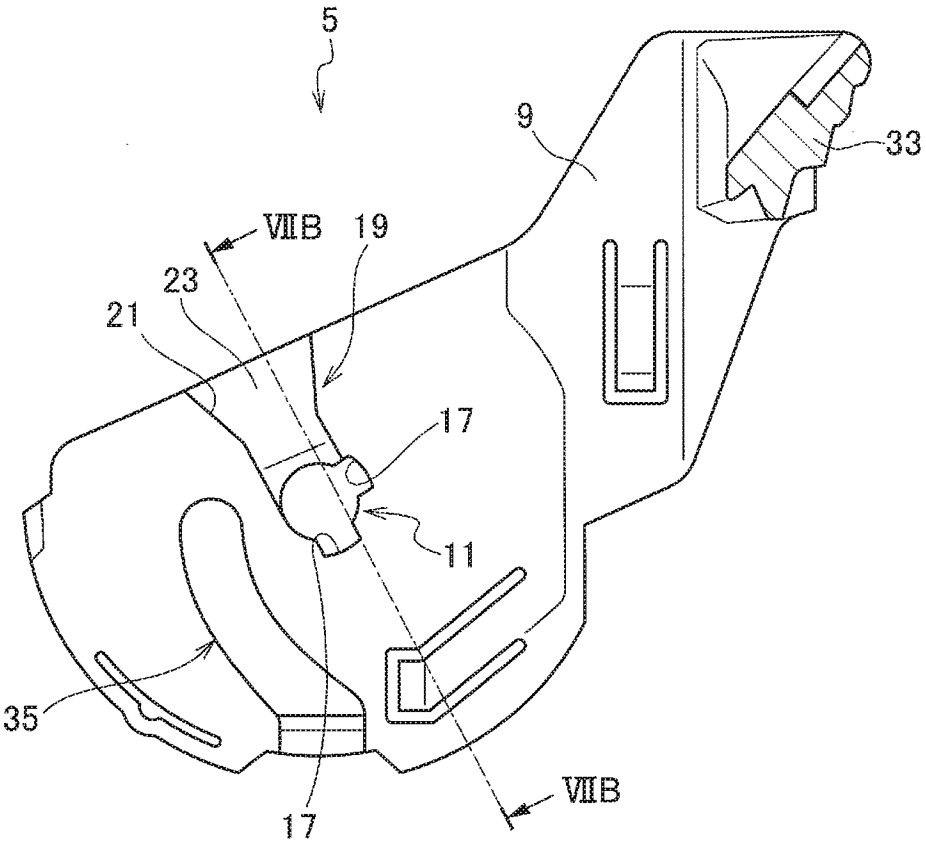
FIG. 7A is a rear view of the lever of the lever type connector according to the embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

A lever type connector 1 according to an embodiment of the present invention is described with reference to FIG. 1 to FIG. 14.

The lever type connector 1 is provided with a housing 3 which can be fitted with an opposite housing, a U-shape lever 5 rotatably attached to the housing 3 and formed to fit the opposite housing with the housing 3 by rotation of the U-shape lever 5, shafts 7, 7 arranged to be protruded from both side surfaces of the housing 3 respectively, and hole portions 11, 11 formed on side plates 9, 9 in a pair of the side plates 9, 9 arranged on the both side surfaces of the housing 3 of the lever 5 respectively, each of the shafts 7, 7 being inserted into each of the hole portions 11, 11.

A protrusion 13 protruded toward an outer side in a radial direction of the shaft 7 is arranged at a distal end of the shaft 7. An opening prevention wall 15 is arranged at an edge of the hole portion 11 so as to face an inner side surface of the protrusion 13 in a state in which the shaft 7 is inserted into the hole portion 11.

A plurality of insertion portions 17 into which the protrusion 13 can be inserted is arranged in the opening prevention wall 15.

A groove 19 which is communicated with the hole portion 11 and formed to lead the shaft 7 toward the hole portion 11 in attaching the lever 5 to the housing 3 is arranged on an inner side surface of each of the pair of side plates 9, 9.

An introduction taper 21 inclined to be spread toward an opening side of the groove 19 is arranged at a front end side of the groove 19 in an attaching direction of the lever 5 to the housing 3. A guide taper 23 inclined such that a depth of the groove 19 is to be shallower from the opening side of the groove 19 toward a side of the hole portion 11 is arranged at a bottom of the groove 19.

One of the insertion portions 17 is arranged to be opposite to the groove 19 while interposing the hole portion 11 with the groove 19.

Regulators 25, 25 contactable with the protrusion 13 in a rotation direction of the lever 5 are arranged in the opening prevention wall 15.

As shown in FIG. 1 to FIG. 14, the housing 3 is formed of insulation material such as synthetic resin, and the housing 3 is formed in a casing like shape and a plurality of terminal housing chambers 27 is formed in the housing 3.

Each of terminals 31 arranged at an end portion of each of electric wires 29 connected to a power source, a device or the like is housed in each of the terminal housing chambers 27 of the housing 3.

The housing 3 can be fitted with an opposite housing (not shown), and when the housing 3 is fitted with the opposite housing, a plurality of opposite terminals (not shown) housed in the opposite housing is electrically connected to a plurality of the terminals 31.

Each of the shafts 7, 7 is arranged on each of the side surfaces of the housing 3 so as to be cylindrically protruded toward an outer side. The lever 5 is rotatably attached to the housing 3 via the shafts 7, 7.

The lever 5 is formed of insulation material such as synthetic resin, and the lever 5 is provided with an operation portion 33 arranged across the housing 3 in a width direction, and the pair of side plates 9, 9 formed by a single member continuous with both end sides of the operation portion 33, each of the pair of side plates 9, 9 being arranged at each of the side surfaces of the housing 3. The lever 5 is formed in a U-shape by the operation portion 33 and the pair of side plates 9, 9.

The lever 5 can be rotated against the housing 3 by the operation portion 33 held by a user.

Each of the hole portions 11, 11 into which each of the shafts 7, 7 is inserted and engaged is arranged on each of the pair of side plates 9, 9 at a part corresponding to each of the shafts 7, 7 protruded from and arranged on each of the side surfaces of the housing 3 such that each of the hole portion 11 penetrates each of the side plates 9, 9 in a thickness direction.

When each of the shafts 7, 7 is inserted into and engaged with each of the hole portions 11, 11, the lever 5 is rotatably attached to the housing 3.

Each of cam grooves 35, 35 engageable with a cam pin (not shown) arranged in the opposite housing is arranged on each of the pair of side plates 9, 9.

When the housing 3 and the opposite housing are fitted with each other, the lever 5 is rotated against the housing 3 while engaging the cam grooves 35, 35 with the cam pins of the opposite housing.

With the rotation of the lever 5, the cam pins of the opposite housing are moved along the cam grooves 35, 35 and thereby the opposite housing is attracted to the housing 3 and fitted with the housing 3, and then the opposite terminals and the terminals 31 are electrically connected.

In this way, the opposite housing and the housing 3 are fitted by the rotation of the lever 5, and thereby fitting force between the opposite housing and the housing 3 can be reduced, and fitting workability can be improved.

In such a lever type connector 1, the protrusion 13 is arranged on the shaft 7 arranged in the housing 3.

The protrusion 13 is formed at one part of the shaft 7 in a circumferential direction at the distal end of the shaft 7, and the protrusion 13 is formed by a single member continuous with the shaft 7 so as to be protruded in a rectangular manner toward the outer side in the radial direction of the shaft 7.

A taper inclined downward from the outer side toward the inner side is formed at a distal end side in a protruding direction of the protrusion 13.

The protrusion 13 is arranged such that an inner side surface of the protrusion 13 faces the opening prevention wall 15 arranged in the hole portion 11 in a state in which the shaft 7 is inserted into the hole portion 11 of the lever 5.

The opening prevention wall 15 is arranged at an edge of the hole portion 11 such that an outer side surface of the opening prevention wall 15 faces the inner side surface of the protrusion 13 in a state in which the shaft 7 is inserted into the hole portion 11.

In this way, the opening prevention wall 15 is arranged in the hole portion 11, and thereby when the pair of side plates 9, 9 is displaced in a direction to be opened, the opening prevention wall 15 contacts with the inner side surface of the protrusion 13 and the opening of the pair of side plates 9, 9 is prevented, and therefore drop-off of the lever 5 from the housing 3 can be prevented.

A plurality of the insertion portions 17 into which the protrusion 13 can be inserted is arranged in the opening prevention wall 15.

The plurality of insertion portions 17 is arranged to penetrate the opening prevention wall 15 in a thickness direction, and several insertion portions 17 (here, two insertion portions 17) are arranged with an interval therebetween in a circumferential direction of the opening prevention wall 15, and the insertion portion 17 is formed in a rectangular shape similar to an outer shape of the protrusion 13 such that the protrusion 13 can be inserted into the insertion portion 17.

When the lever 5 is attached to the housing 3, the pair of side plates 9, 9 of the lever 5 is opened and inserted into the housing 3, and when the pair of side plates 9, 9 is returned, the insertion portion 17 is matched with the protrusion 13 of the shaft 7 and the protrusion 13 is inserted into the insertion portion 17, and thereby the shaft 7 can be inserted into the hole portion 11.

Such a plurality of the insertion portions 17 (here, two insertion portions 17) into which the protrusion 13 can be inserted is arranged in the opening prevention wall 15, and thereby the protrusion 13 and the insertion portion 17 can be matched with each other at a plurality of rotation positions of the lever 5 against the housing 3, and therefore attaching and detaching of the lever 5 can be performed at the plurality of rotation positions of the lever 5.

The groove 19 is communicated with the hole portion 11 having the plurality of insertion portions 17.

Each of the grooves 19 is formed in a recessed shape having a bottom in the inner side surface of each of the pair of side plates 9, 9. One end of the groove 19 is opened toward a side portion of each of the pair of side plates 9, 9 and another end of the groove 19 is communicated with the hole portion 11.

When the lever 5 is attached to the housing 3, an opening at one end side of the groove 19 is engaged with the shaft 7 of the housing 3 and thereby the shaft 7 is moved along the groove 19 and therefore the shaft 7 is led to the hole portion 11.

In this way, the groove 19 is arranged on the lever 5, and thereby the shaft 7 of the housing 3 can be led stably to the hole portion 11 of the lever 5, and therefore assemblability of the lever 5 to the housing 3 can be improved.

In addition, since each of the grooves 19 is formed in the recessed shape having the bottom in the inner side surface of each of the pair of side plates 9, 9, rigidity of the pair of side plates 9, 9 can be maintained compared to a case in which each of the grooves 19 is arranged to penetrate each of the pair of side plates 9, 9 in the thickness direction.

The groove 19 is arranged to be opposite to one of the insertion portions 17 while interposing the hole portion 11 with the insertion portion 17.

In this way, the groove 19 and the insertion portion 17 are arranged, and thereby the protrusion 13 of the shaft 7 led to the hole portion 11 by the groove 19 and the insertion portion 17 of the hole portion 11 can be matched with each other by a series of the attaching operation of the lever 5 to the housing 3, and therefore the assemblability of the lever 5 to the housing 3 can be improved.

The introduction taper 21 and the guide taper 23 are arranged in the groove 19.

The introduction taper 21 is arranged at the front end side of the groove 19 in the attaching direction of the lever 5 to the housing 3, and the introduction taper 21 is inclined such that the opening of the groove 19 is spread toward the outer side.

In this way, the introduction taper 21 is arranged in the groove 19, and thereby the shaft 7 of the housing 3 can be led stably to the groove 19 when the lever 5 is attached to the housing 3.

The guide taper 23 is arranged at the bottom of the groove 19, and the guide taper 23 is inclined such that the depth of the groove 19 is to be shallower from the opening side of the groove 19 toward the side of the hole portion 11.

In this way, the guide taper 23 is arranged in the groove 19, and thereby the shaft 7 of the housing 3 led to the groove 19 slides with the guide taper 23, and therefore the pair of side plates 9, 9 can be opened automatically. In this way, the introduction taper 21 and the guide taper 23 are arranged in the groove 19, and thereby introduction of the shaft 7 toward the groove 19 and opening of the pair of side plates 9, 9 can be performed by the series of the attaching operation of the lever 5 to the housing 3, and therefore the attaching of the lever 5 to the housing 3 can be performed easily.

Here, the regulators 25, 25 contactable with the protrusion 13 in the rotation direction of the lever 5 are arranged in the opening prevention wall 15 of the hole portion 11.

The regulators 25, 25 regulate the rotation of the lever 5 by contacting the protrusion 13 in the rotation direction of the lever 5 when the lever 5 is rotated in an unexpected direction.

In this way, the regulators 25, 25 are arranged in the hole portion 11, and thereby the rotation direction of the lever 5 or a rotation range of the lever 5 can be regulated, and therefore an useless rotation space of the lever 5 can be reduced.

Figure 8:
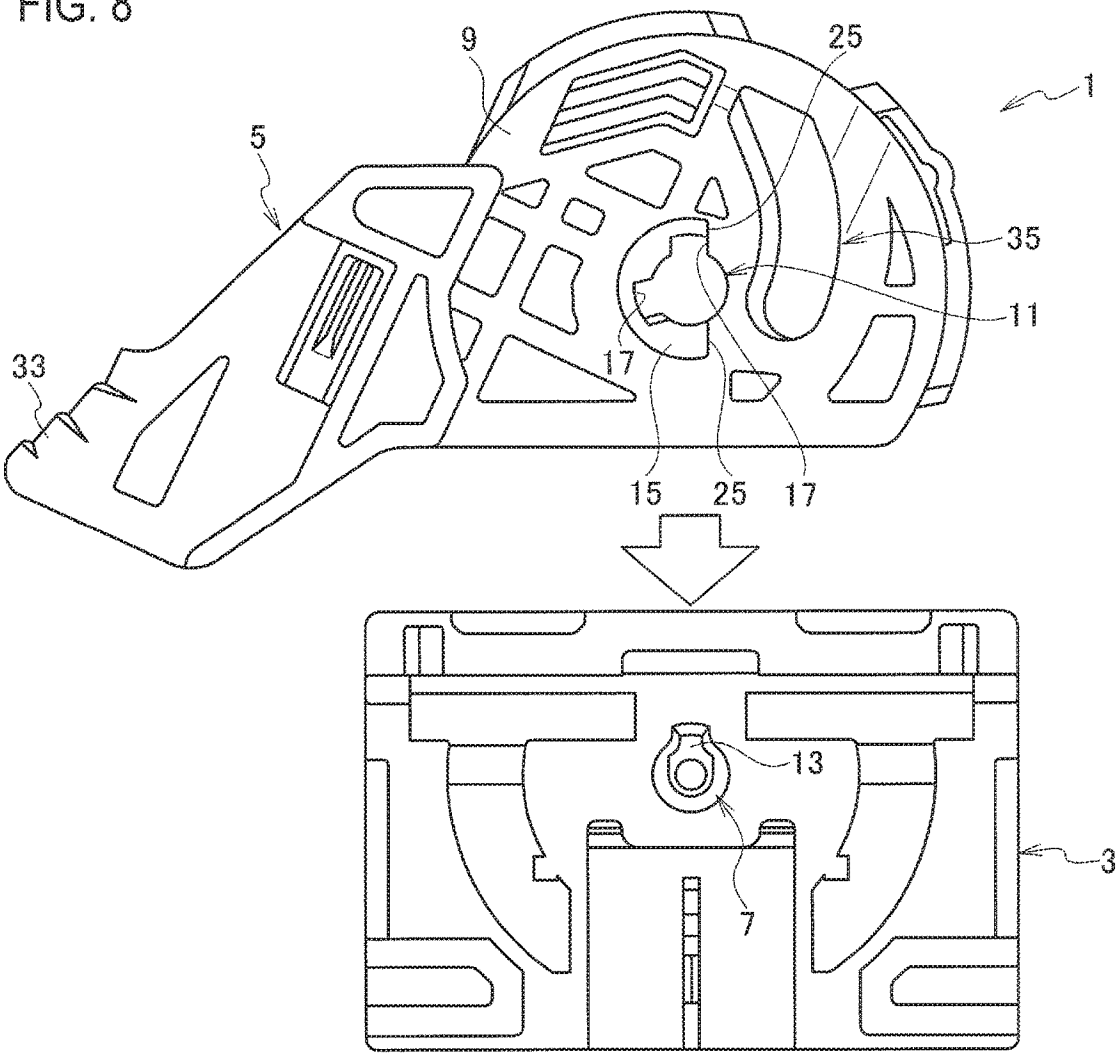
FIG. 8 is a side view in attaching the lever to the housing of the lever type connector according to the embodiment.

The attaching of the lever type connector 1 having such a configuration is started firstly, as shown by an arrow in FIG. 8, by attaching of the lever 5 by directing the opening side of the groove 19 of the lever 5 toward the housing 3.

Next, the shaft 7 of the housing 3 is moved along the groove 19, and then the lever 5 is attached to the housing 3 while opening the pair of side plates 9, 9 by the guide taper 23 of the groove 19.

Figure 9:
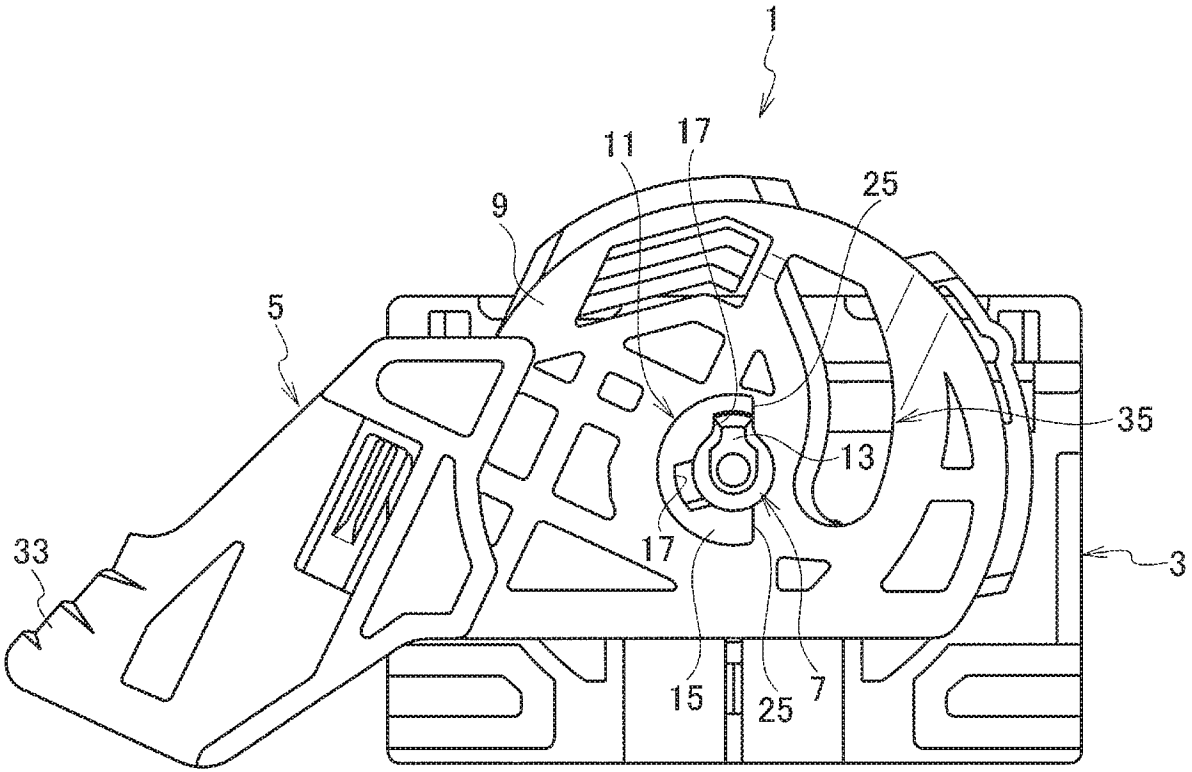
FIG. 9 is a side view after the lever is attached to the housing of the lever type connector according to the embodiment. embodiment.

Next, as shown in FIG. 9, when the shaft 7 and the hole portion 11 are matched with each other, the protrusion 13 of the shaft 7 and the insertion portion 17 of the hole portion 11 are matched with each other, and the pair of side plates 9, 9 is returned and the shaft 7 is inserted into the hole portion 11, and thereby the lever 5 is rotatably attached to the housing 3.

In the rotation position of the lever 5 against the housing 3, the protrusion 13 of the shaft 7 and the insertion portion 17 of the hole portion 11 are matched with each other, and thereby the lever 5 can be detached from the housing 3.

In this state, the protrusion 13 of the shaft 7 and one of the regulators 25 of the opening prevention wall 15 face each other in another rotation direction of the lever 5 (a direction opposite to an arrow in FIG. 10), and therefore the rotation of the lever 5 in the another direction is regulated.

Figure 10:
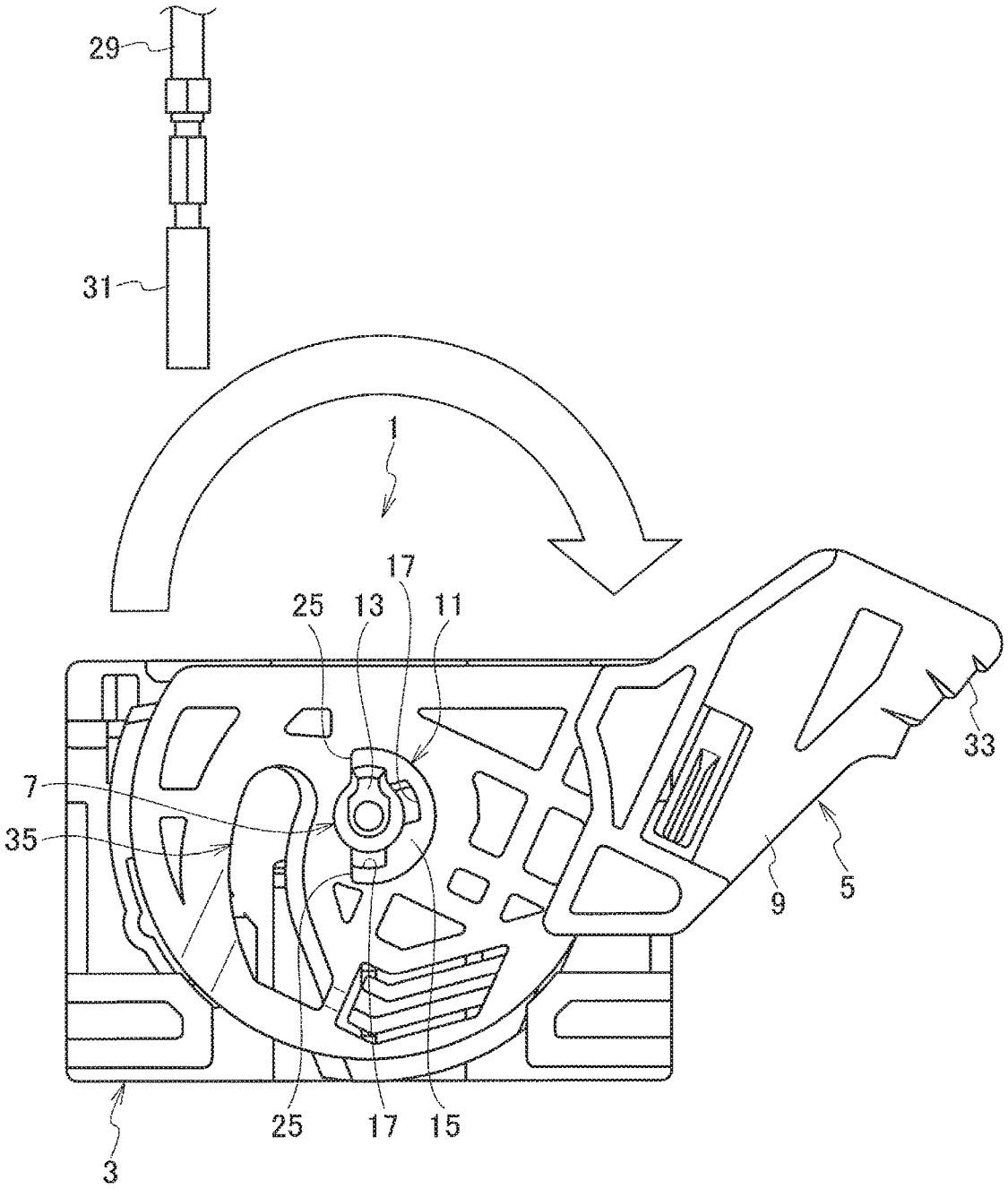
FIG. 10 is a side view in housing a terminal in the housing while rotating the lever of the lever type connector according to the embodiment.

Next, as shown by the arrow in FIG. 10, the lever 5 is rotated against the housing 3 and the terminals 31 are housed in the terminal housing chambers 27 of the housing 3 respectively.

In this state, the protrusion 13 of the shaft 7 and the opening prevention wall 15 of the hole portion 11 face each other in an opening direction of the pair of side plates 9, 9, and therefore the opening of the pair of side plates 9, 9 is prevented.

In addition, in this state, the protrusion 13 of the shaft 7 and another one of the regulators 25 of the opening prevention wall 15 face each other in one rotation direction of the lever 5 (a direction of the arrow in FIG. 10), and therefore further rotation of the lever 5 in the one rotation direction is regulated.

Further, an insertion side of the terminal 31 of the housing 3 is not covered by the lever 5, and therefore the terminal 31 is easily inserted. Further, in FIG. 10, one of the terminals 31 is representatively shown, however a plurality of the terminals 31 is housed in the housing 3.

Figure 11:
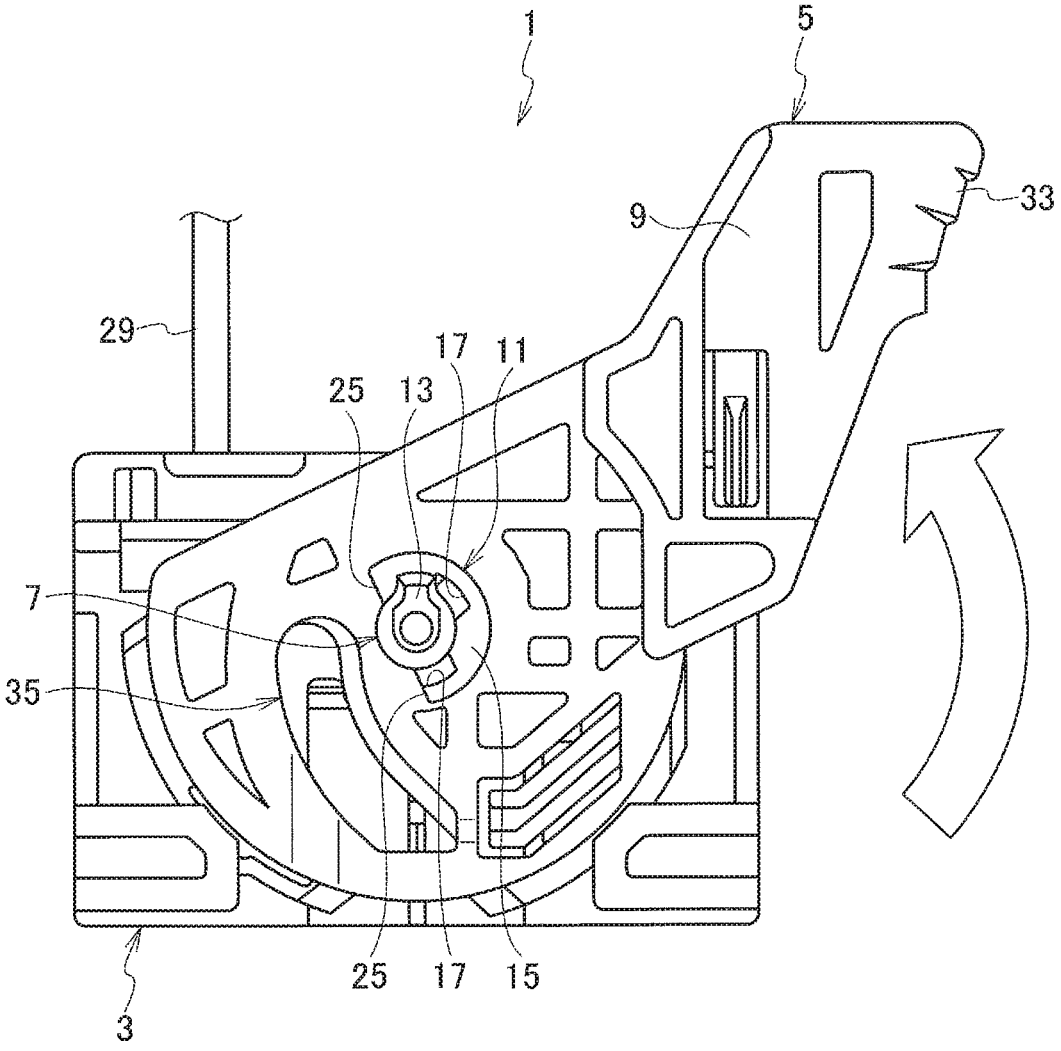
FIG. 11 is a side view when the lever is rotated in a state in which the terminal is housed in the housing of the lever type connector according to the embodiment.

Next, as shown by an arrow in FIG. 11, the lever 5 is rotated against the housing 3, and an opening of the cam groove 35 of the lever 5 is arranged to face a fitting direction with the opposite housing.

In this state, the protrusion 13 of the shaft 7 and the opening prevention wall 15 of the hole portion 11 are arranged to face each other in the opening direction of the pair of side plates 9, 9, and thereby the opening of the pair of side plates 9, 9 is prevented.

Figure 12:
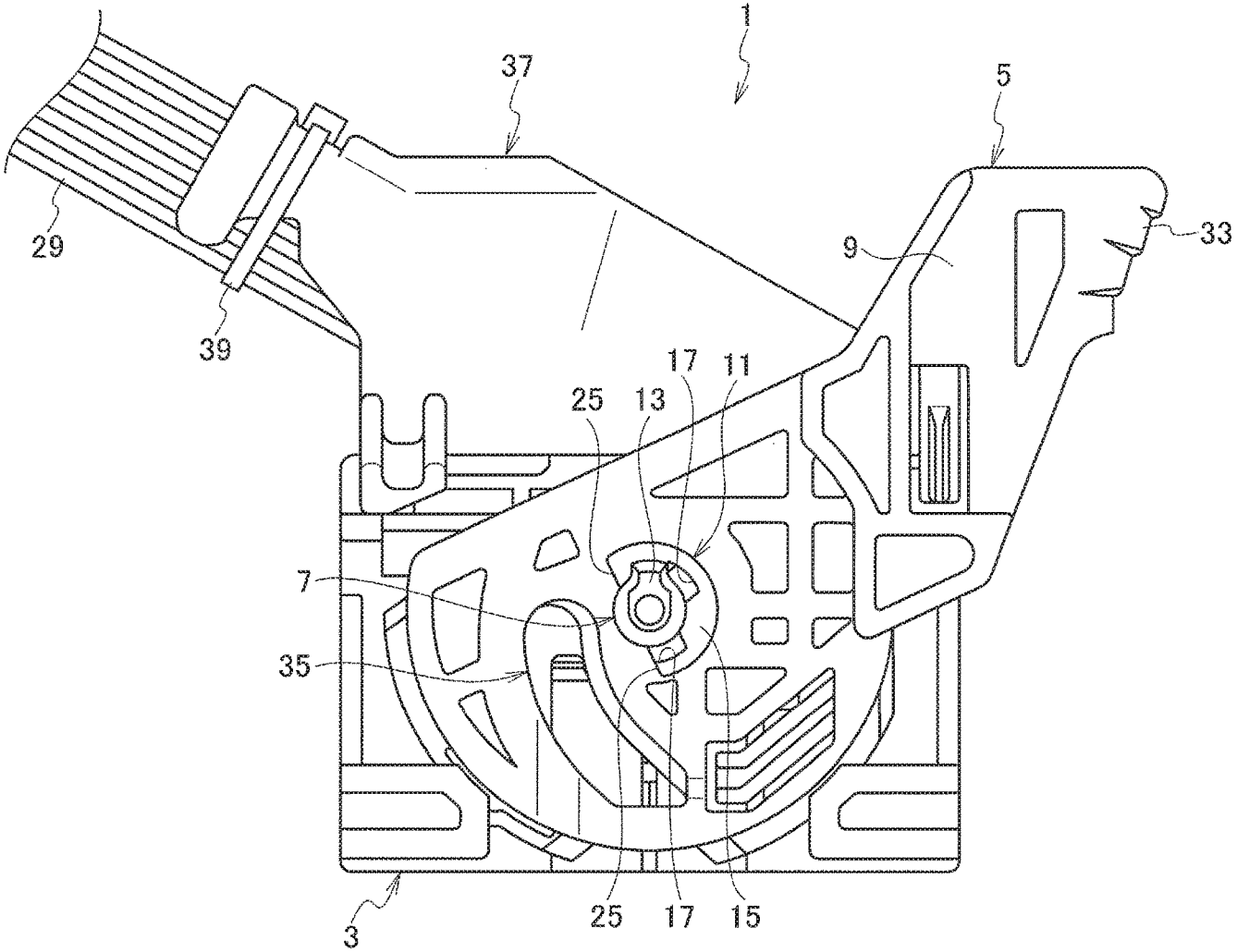
FIG. 12 is a side view after a cover is attached to the housing of the lever type connector according to the embodiment.

Next, as shown in FIG. 12, a cover 37 is attached at a drawn side of the electric wire 29 of the housing 3, and then the electric wires 29 are bound by a binding band 39.

Figure 13:
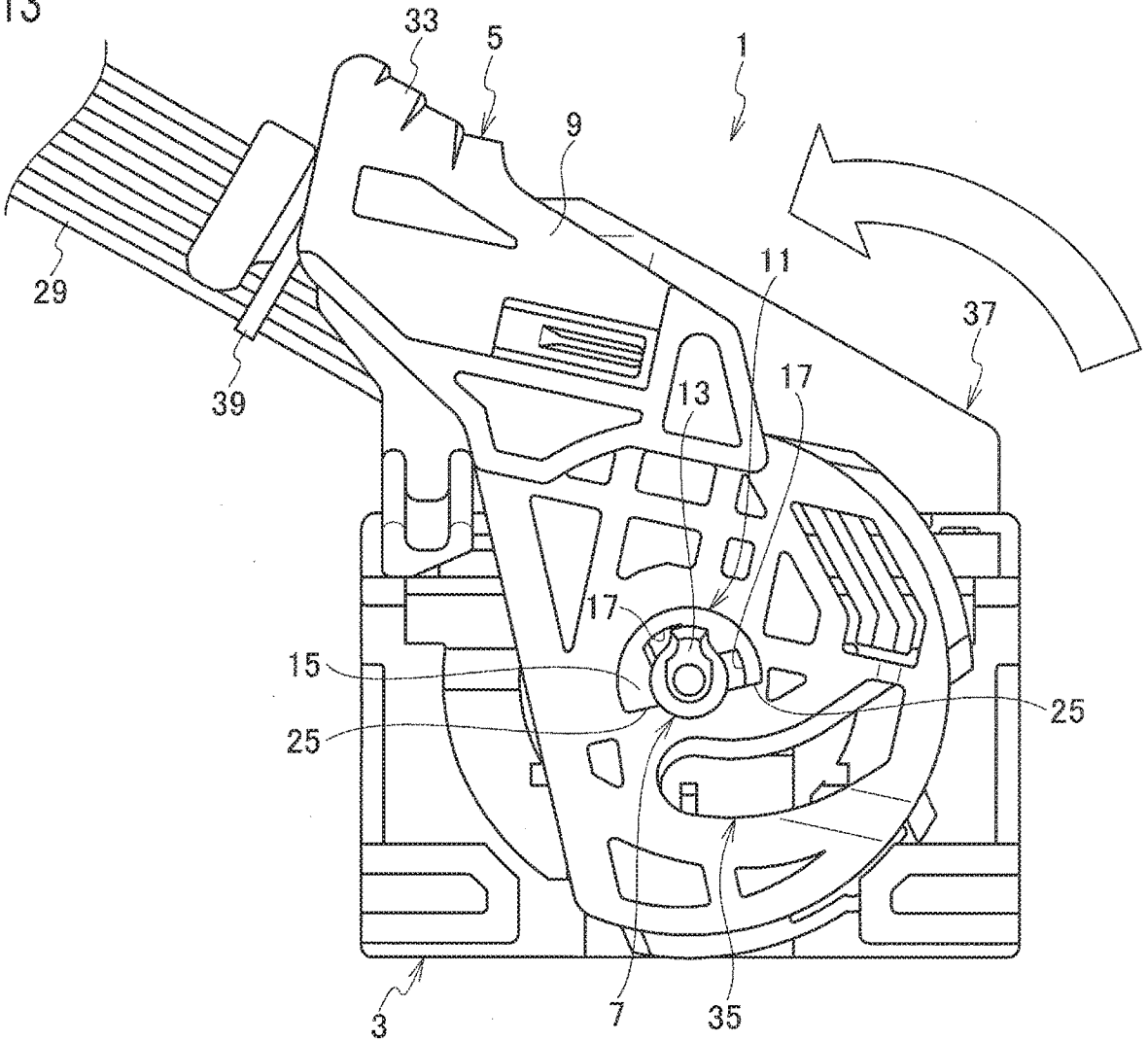
FIG. 13 is a side view when the lever is rotated in fitting an opposite housing with the housing of the lever type connector according to the embodiment.

Further, the opposite housing is fitted with a side opposite to the drawn side of the electric wire 29 of the housing 3, and as shown by an arrow in FIG. 13, the lever 5 is rotated against the housing 3, and the fitting of the housing 3 with the opposite housing is completed.

In this state, the protrusion 13 of the shaft 7 and the opening prevention wall 15 of the hole portion 11 are arranged to face each other in the opening direction of the pair of side plates 9, 9, and therefore the opening of the pair of side plates 9, 9 is prevented.

Figure 14:
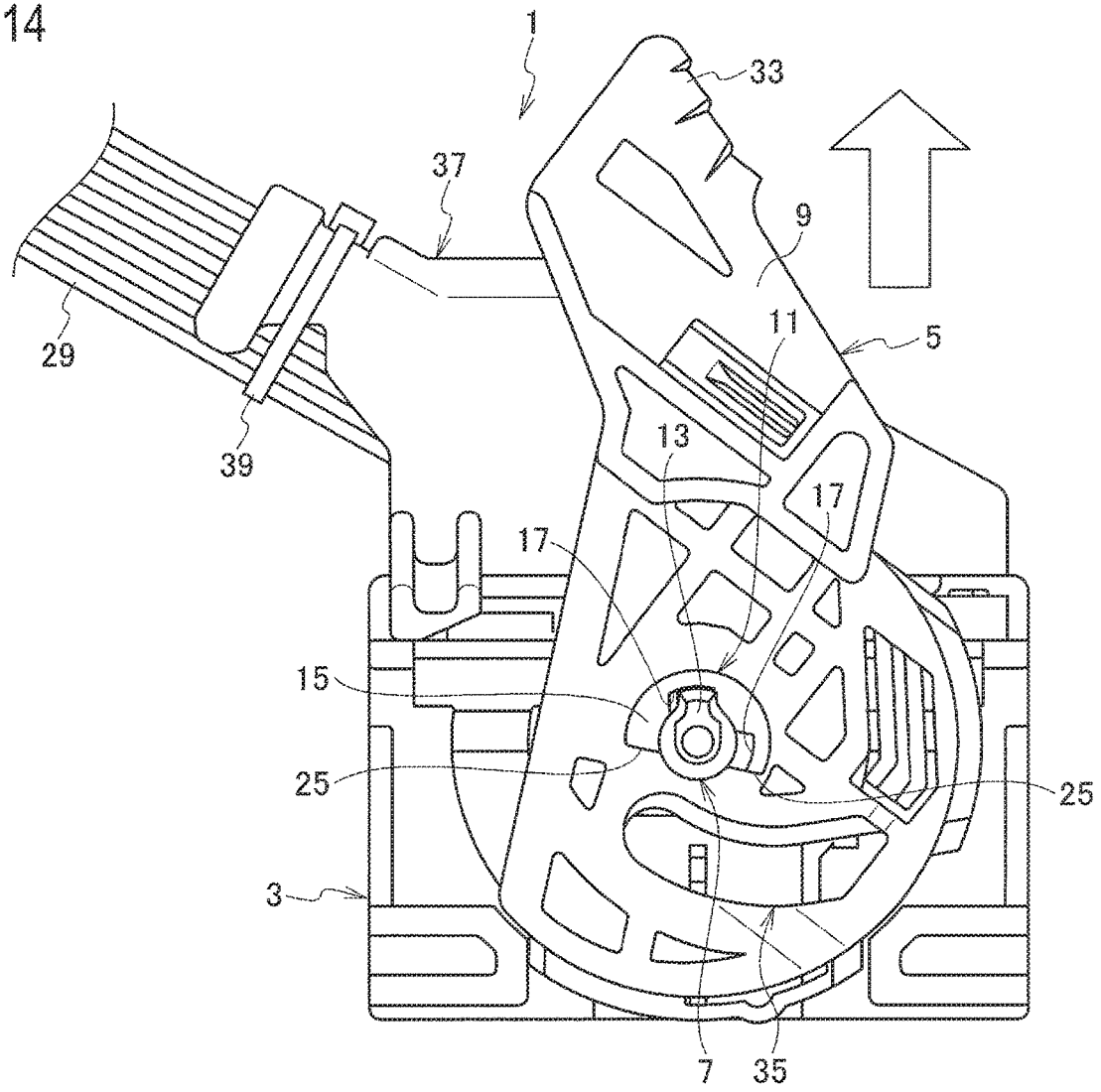
FIG. 14 is a side view when the lever is rotated in a state in which the opposite housing is fitted with the housing of the lever type connector according to the embodiment.

In a case in which the lever 5 is detached from the housing 3 in a state in which the housing 3 is fitted with the opposite housing, as shown in FIG. 14, the lever 5 is slightly rotated such that the protrusion 13 of the shaft 7 and the insertion portion 17 of the hole portion 11 are matched with each other, and then the pair of side plates 9, 9 is opened, and thereby the lever 5 can be detached from the housing 3 as shown by an arrow.

In this way, the plurality of insertion portions 17 in which the protrusion 13 can be inserted into the hole portion 11 is arranged, and thereby the protrusion 13 and the insertion portion 17 can be matched with each other at the plurality of rotation positions of the lever 5 against the housing 3, and the attaching and the detaching of the lever 5 can be performed at the plurality of rotation positions of the lever 5.

In such a lever type connector 1, since a plurality of the insertion portions 17 into which the protrusion 13 can be inserted is arranged in the opening prevention wall 15, a position in which the protrusion 13 of the shaft 7 and the insertion portion 17 of the hole portion 11 are matched with each other to enable the pair of side plates 9, 9 of the lever 5 to be opened is defined by a plurality of positions in the rotation direction of the lever 5 against the housing 3.

Thus, the protrusion 13 of the shaft 7 and the insertion portion 17 of the hole portion 11 can be matched with each other at the plurality of positions in the rotation direction of the lever 5 against the housing 3, and the attaching or the detaching of the lever 5 against or from the housing 3 can be performed.

Accordingly, in such a lever type connector 1, the assemblability of the lever 5 against the housing 3 can be improved.

Further, since the groove 19 which is communicated with the hole portion 11 and is formed to lead the shaft 7 to the hole portion 11 when the lever 5 is attached to the housing 3 is arranged in the inner side surface of each of the pair of side plates 9, 9, the shaft 7 can be led f firmly to the hole portion 11 when the lever 5 is attached to the housing 3.

Further, since the introduction taper 21 and the guide taper 23 are arranged in the groove 19, the shaft 7 can be led stably to the groove 19 by the introduction taper 21 and the pair of side plates 9, 9 can be opened stably by the guide taper 23, and therefore the attaching of the lever 5 to the housing 3 can be performed easily.

Further, since one of the insertion portions 17 is arranged to be opposite to the groove 19 while interposing the hole portion 11 with the groove 19, the protrusion 13 of the shaft 7 and the insertion portion 17 can be matched with each other continuously by the attaching operation of the lever 5 to the housing 3, and therefore the attaching of the lever 5 to the housing 3 can be performed easily.

Further, since the regulators 25, 25 contactable with the protrusion 13 in the rotation direction of the lever 5 are arranged in the opening prevention wall 15, the rotation of the lever 5 can be regulated by contact between the protrusion 13 and the regulators 25, 25, and therefore downsizing can be achieved by reducing the useless rotation space of the lever 5.

Further, in the lever type connector according to the embodiment, two insertion portions are arranged in the opening prevention wall, however it is not limited to this, and three or more insertion portions may be arranged in the opening prevention wall.

Further, the protrusion is arranged at one position in the circumferential direction of the shaft, however it is not limited to this, and for example, the protrusions may be arranged at two positions to form a pair of protrusions facing each other in the circumferential direction of the shaft, and a plurality of insertion portions (for example, four insertion portions) may be arranged in the opening prevention wall in order to correspond to the pair of protrusions.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A lever type connector comprising:

a housing fittable with an opposite housing;

a lever formed in a U-shape, rotatably attached to the housing, and having a pair of side plates arranged at both side surfaces of the housing, a rotation of the lever fitting the oppisite housing with the housing;

shafts protruding from the both side surfaces of the housing respectively; and hole portions arranged in the pair of side plates respectively, the hole portions into which the shafts are inserted, wherein each of the shafts comprises a protrusion protruding toward an outer side in a radial direction of the shaft at a distal end of the shaft, each of the hole portions comprises an opening prevention wall arranged at an edge of the hole portion and facing an inner side surface of the protrusion with the shaft being inserted into the hole portion, and the opening prevention wall comprises a plurality of insertion portions into which the protrusion is insertable, wherein each of the pair of side plates comprises a groove arranged on an inner side surface of each of the pair of side plates, the groove communicating with the hole portion and leading the shaft to the hole portion upon attachment of the lever to the housing, and the groove comprises:

an introduction taper located at a front end side of the groove in an attaching direction of the lever to the housing and inclined such that the introduction taper spreads toward an opening side of the groove; and a guide taper located at a bottom of the groove and inclined such that a depth of the groove is shallower from the opening side of the groove toward the hole portion.

2. The lever type connector according to claim 1, wherein one of the insertion portions and the groove face each other with the hole portion being interposed between the one of the insertion portions and the groove.

3. The lever type connector according to claim 1, wherein the opening prevention wall comprises a regulator contactable with the protrusion in a rotation direction of the lever.

* * * * *